US005165545A

United States Patent [19]

Focke et al.

[11] Patent Number: 5,165,545

[45] Date of Patent: Nov. 24, 1992

[54] SOFT PACK, ESPECIALLY PAPER TISSUE PACK

[76] Inventors: Heinz Focke, Moorstr. 64, 2810 Verden; Jürgen Wach, Mittelsbürener Landstr. 2a, 2820 Bremen 77, both of Fed. Rep. of Germany

[21] Appl. No.: 732,006

[22] Filed: Jul. 18, 1991

Related U.S. Application Data

[63] Continuation of Ser. No. 531,415, May 31, 1990, Pat. No. 5,040,685.

[30] Foreign Application Priority Data

Jun. 5, 1989 [DE] Fed. Rep. of Germany ..... 3918325

[51] Int. Cl.[5] ..... B65D 85/62; B65D 75/62

[52] U.S. Cl. ..... 206/494; 206/812; 383/203

[58] Field of Search ..... 206/233, 449, 494, 607, 206/608-612, 625, 627-630, 812; 383/203, 206, 207

[56] References Cited

U.S. PATENT DOCUMENTS 3,167,238 1/1965 Smith ..... 206/625
3,737,095 6/1973 Derauf ..... 206/629
4,158,412 6/1979 Wysocki ..... 206/612
4,460,088 7/1984 Rugenstein et al. ..... 206/625

FOREIGN PATENT DOCUMENTS 2334584 7/1977 France .
0980551 1/1965 United Kingdom ..... 206/625

*Primary Examiner*—Jimmy G. Foster

[57] ABSTRACT

Stacks of folded paper tissues are usually enwrapped with a thin foil, thus forming a soft pack. Lately these packs are provided with a reclosable opening aid. This opening aid can be arranged in the region of a narrow longitudinal face of the pack, with an outer folding flap (18) at the same time serving as closing flap (23). In order to facilitate handling and to ensure a higher stability of the pack, the opening aid is designed such that only a portion of the outer folding flap (18) is formed as a closing flap (23), while the inner continuous folding flap (17) remains in the original pack position even when the pack is opened. The ends of the folding flap (17) are anchored to marginal side cross-strips (28, 29) of the outer folding flap (18). A recess (29) arranged preferably central in the region of the inner folding flap (17) and being open towards the free edge expediently enlarges the extraction opening (30) for the paper tissues.

2 Claims, 3 Drawing Sheets

SOFT PACK, ESPECIALLY PAPER TISSUE PACK

This is a continuation of application Ser. No. 07/531,415, filed May 31, 1990, now U.S. Pat. No. 5,040,685.

BACKGROUND OF THE INVENTION

The invention relates to a soft pack, especially a paper tissue pack, consisting of a wrapping surrounding the pack content made of plastics foil or the like, by means of which the front wall, rear wall, side walls, end wall and bottom wall are formed, with a reclosable opening aid being formed in the region of a narrow pack face, preferably in the region of an elongated side wall, said opening aid consisting of two folding flaps (partially) overlapping one another in closing position, the outer folding flap of which forming a closing flap for an extraction opening and having an adhesive tape or adhesive label, a portion of which being releasably connected to an adjoining pack face (front wall).

Stacks of folded paper tissues are generally enwrapped with thin plastics foil. Lately such paper tissue packs are provided with a reclosable opening aid.

FR-A 2 334 584 shows and describes different embodiments of such paper tissue packs. One of these known packs is formed such that the opening aid is disposed in the region of one of the two elongated narrow side walls. Because the wrapping surrounding the tissues is folded in a tubular manner, this side wall consists of two folding flaps overlapping one another. Both of these folding flaps have a transversely oriented severance cut at their ends adjacent to the end wall and the bottom wall, which extends across the full width of the side wall. Both folding flaps therefore serve as closing flaps.

In the region of the closing flaps formed by the two folding flaps, these folding flaps are joined to one another with an easily releasable seal. For this purpose, at least one side of the folding flaps to be joined is provided with a coating which guarantees an easily openable sealing or welding of the two closing flaps.

An adhesive tape serves for opening and reclosing the pack. One portion of this adhesive tape is connected to the outer closing flap and another portion is releasably connected to the adjoining front wall of the pack. The latter end of the adhesive strip is provided with an adhesive-free grip tab.

SUMMARY OF THE INVENTION

The invention is based on the object to improve packs of the aforementioned type, especially with respect to the handling of the pack as regards easier extraction of the tissues while maintaining or rather improving the dimensional stability of the pack.

In order to attain this object, the soft pack according to the invention is characterized in that only the outer folding flap serves as a closing flap which extends across a (center) portion of the (outer) folding flap and which is limited from lateral portions (side cross-strips) of said folding flap by severance cuts which are extended as linear perforation lines in the region of the pack wall (rear wall) joined to the outer folding flap.

The formation of the reclosable opening aid as taught by the invention ensures a facilitated handling of the pack, since only one closing flap has to be operated to get to the pack content. Because of the extension or continuation of the closing flap into the region of an adjoining pack wall (rear wall), a portion of the side faces of the tissue pack is also uncovered when the pack is open, so that the foremost tissue can be comfortably grasped with two fingers. The process of opening and reclosing the pack is facilitated as well, because only one closing flap—with the aid of the adhesive tape affixed to the closing flap—has to be operated for each process.

The opening aid is preferably arranged in the region of an elongated side wall of the pack. According to the invention, the closing flap is smaller in length than the outer folding flap, out of which the closing flap is formed by means of two spaced apart severance cuts or perforation lines. The remnant cross-strips or side cross-strips remaining at the ends of the outer folding flaps—adjacent to the end or bottom wall—are tightly joined to end portions of the inner folding flap, especially by sealing the foil. This ensures a box-shaped and consequently very stable formation in the area of the end and bottom face next to the extraction opening.

A further independent feature of the invention is that for enlarging the extraction opening, the inner folding flap is provided with a recess open towards the free edge and therewith towards the extraction opening, especially with curved limitation. Thus, a larger extraction opening is exposed when the closing flap is opened.

The recess is formed by a foil piece being removed, i.e. torn away, said foil piece being joined to the inner face of the closing flap and being torn out of the recess on the first opening of the closing flap.

The soft pack according to the invention can be mass produced with conventional machines. The specific construction guarantees an increased stability, so that even very thin foil can be used. The opening aid is designed for easy and trouble-free handling.

Details of an embodiment of the invention are described below with reference to the drawings which show:

DETAILED DESCRIPTION OF A PREFERRED EMBODIMENT

Figure 1:
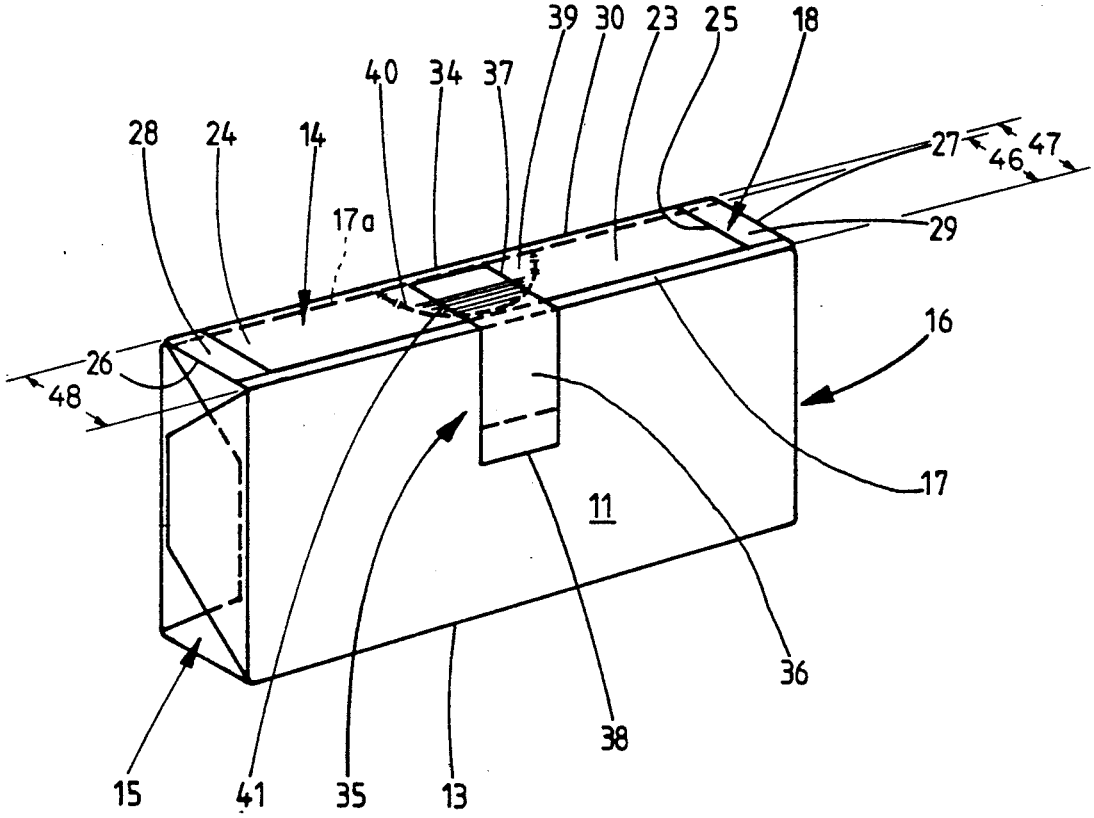
FIG. 1 a perspective view of a pack for holding a stack of folded paper tissues with closed flap, FIG. 2 a section of a web material for forming blanks for packs as shown in FIG. 1, FIG. 3 a perspective view of a pack similar to FIG. 1 with opened flap.
Figure 2:
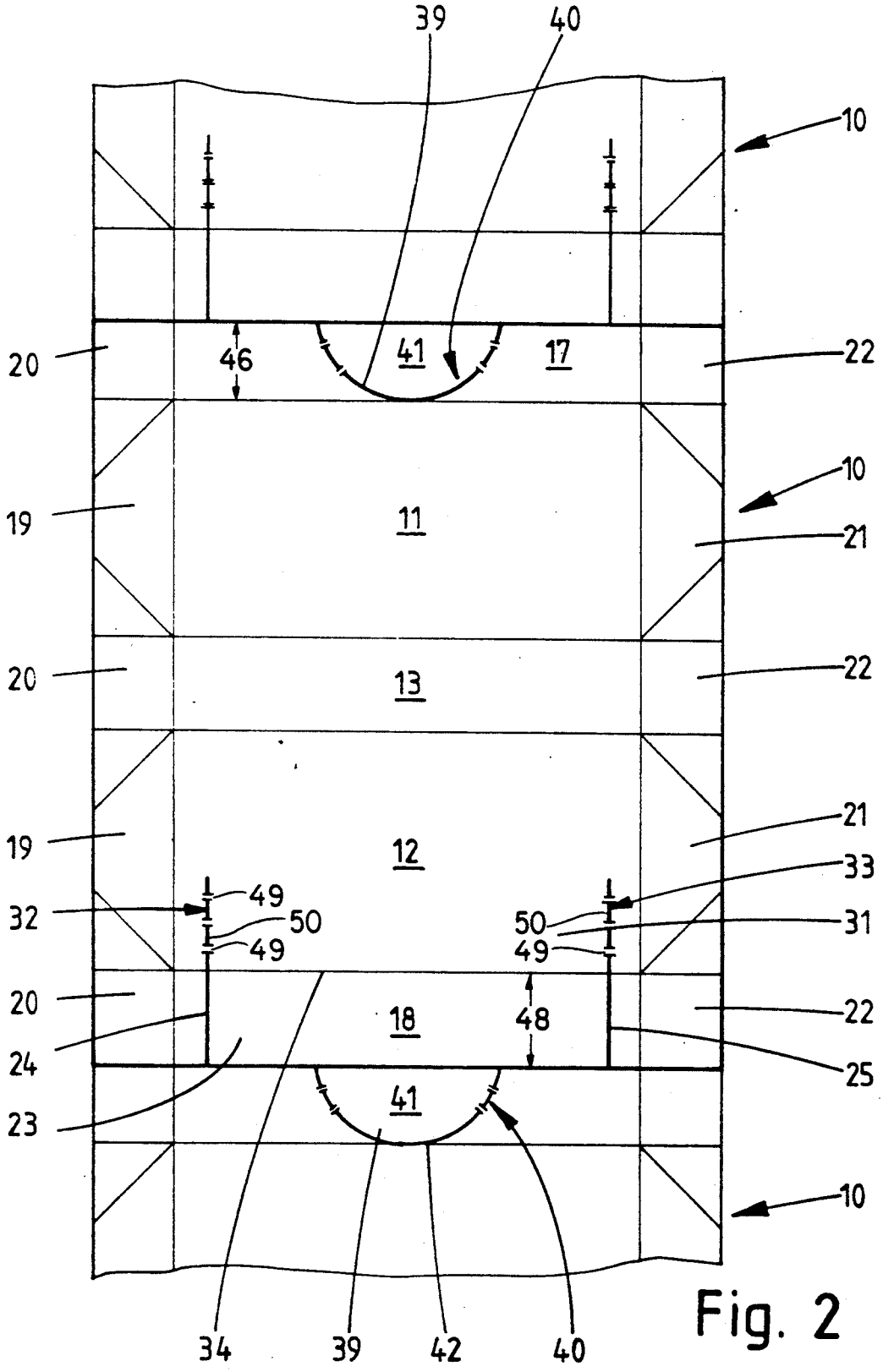
Figure 3:
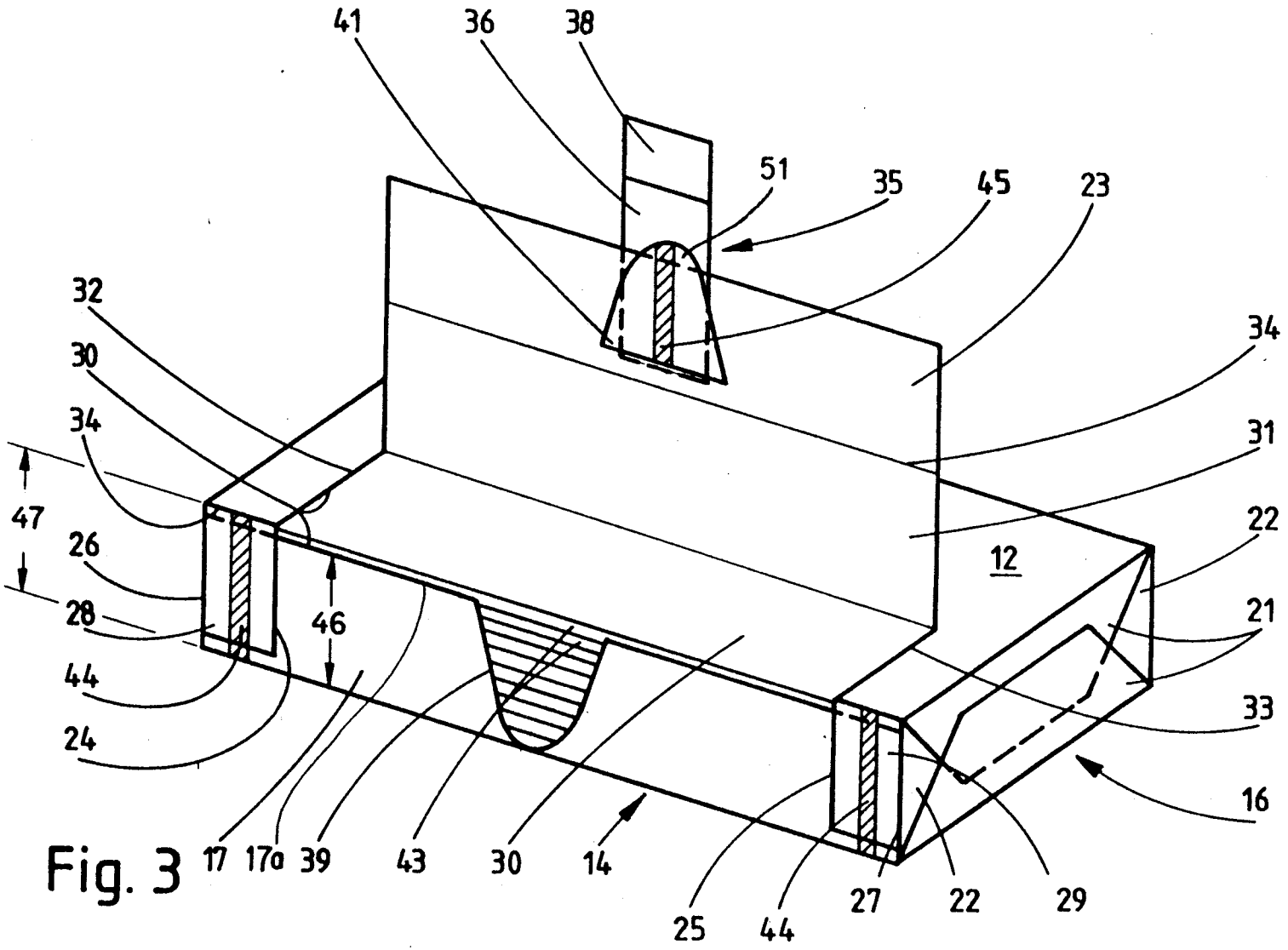

The pack shown in FIGS. 1 and 3 serves for holding a stack of folded paper tissues 43. The pack content is enwrapped by a rectangular blank 10 (FIG. 2) made of thin plastics foil. The wrapping is closed all round and forms a front wall 11, an oppositely situated rear wall 12, elongated narrow side walls 13 and 14 and a small end wall 15 and opposite a bottom wall 16.

The pack is formed in the known way by folding the blank in a U-shaped manner around the cuboidal pack content such that folding flaps 17, 18 nearly completely overlap one another (socalled tubular folding) for forming the side wall pointing upwards in FIG. 1. The folding flaps 17, 18 are joined to one another in a suitable way.

End wall 15 and bottom wall 16 are formed by folding flaps projecting from the pack content, namely by end flaps 19 and end side flaps 20 and bottom flaps 21 and bottom side flaps 22, respectively. The aforesaid folding flaps are folded envelope-like against the pack content, such that the end flaps 19 and the bottom flaps 21 take on a trapezoidal shape (FIGS. 1 and 3).

The pack is provided with a reclosable opening aid which in the present embodiment is in the region of the narrow elongated side wall 14. The folding flaps 17 and 18 of said side wall 14 take part in forming the opening aid.

The outer folding flap 18—which overlaps and thus rests on the inner folding flap 17—has a width 48 and forms a closing flap 23. For this purpose, the folding flap 18 which extends nearly across the full width 47 of the side wall 14 is provided with the transverse severance cuts 24, 25 near the ends, i.e. adjacent to the end wall 15 and the bottom wall 16. Said cuts extend at a distance from transverse edges 26, 27 between side wall 14 on the one hand and end wall 15 and bottom wall 16 on the other. Thus, side cross-strips 28, 29 being part of the folding flap 18 are formed adjacent to end and bottom wall.

In order to open the pack, the closing flap 23 can be lifted as a part of the folding flap 18 into an upright position (FIG. 3) or back against the rear wall 12. Herewith, an extraction opening 30 there is exposed in only a portion of the rear wall 12" which essentially extends only very slightly into the elongated side wall 14 down to the free edge 17*a* (as seen in FIG. 3) of the inner folding flap 17. Which (as shown in FIGS. 1, 2 and 3) is only very slightly narrower than the elongated side wall 14. A foremost or upper tissue 43 can be extracted at a time via this extraction opening.

FIG. 2 reveals that means are provided for enlarging the extraction opening 30. For this reason, the closing flap 23 formed by the folding flap 18 is extended into the region of the rear wall 12, i.e. said closing flap is provided with a flap extension 31. This flap extension is limited by lateral punch or perforation lines 32, 33 in the rear wall 12. These perforation lines 32, 33 extend the severance cuts 24, 25 across a longitudinal edge 34. Whereas the severance cuts 24, 25 are continuous, the perforation lines 32, 33 consist of perforations 49 separated by residual connecting webs 50 of the wrapping.

When the pack is opened by lifting the closing flap 18 and by severing the perforation lines 32, 33, an extraction opening 30 is formed extending into a portion of the rear wall 12, which ensures an easy extraction of the paper tissues 43.

The side cross-strips 28, 29 of the outer folding flaps 18 are tightly sealed or glued to the upper face of the inner folding flap 17. In this region there is a durable connection between the marginal side cross-strips 28, 29 and the inner folding flap 17, in this case by sealing strips 44.

In the region of the closing flap 23, there is a releasable connection—before the pack is put into use—with the inner folding flap 17 which ensure that the closing flap 23 can be lifted in order to open the pack. For this purpose, the upper face of the inner folding flap 17 is provided with a coating (lacquer or print coating) by means of which the folding flaps 17 and 18 can be connected by thermal sealing such that the connection is of low durability and can thus be removed by pulling off the outer folding flap 18.

An adhesive tape 35 is assigned to the closing flap 23 for opening and reclosing the pack. This tape is connected—in closing position—to the front wall 11 with a leg 36 in closing position and to the side wall 14 or the outer face of the closing flap 23 with a second leg 37. Leg 36 is provided with an adhesive-free grip end 38 for grasping the adhesive tape 35.

When opening the pack, the adhesive strip 35 is grasped at the grip end 38. The leg 36 is pulled off the front wall 11. Further upward movement releases the closing flap from the inner folding flap 17, the connection of the adhesive tape 35 with the closing flap 23 being maintained. Finally the closing flap 23 is pulled into complete opening position, herewith severing the perforation liens 32, 33. For reclosing the pack the steps are performed in reverse order.

In order to improve or enlarge the extraction opening 30, a recess 39 is formed in the shown embodiments in the inner folding flap 17 which is open towards the free edge of the folding flap 17 and therewith towards the extraction opening 30. The recess 39 extends in a center region of the folding flap 17, so that edges pointing up or to the side of a number of paper tissues 43 are exposed, thus facilitating the grasping of a tissue for extraction.

In the embodiment of FIG. 1 and FIG. 2, the recess 39 is formed by a curved, specifically semicircular perforation 40 in the region of the folding flap 17. It is limited by a foil piece 41 which is severed out of the connection with the folding flap 17 on the first opening of the pack. For this purpose, said foil piece 41 is tightly connected to the bottom face of the closing flap 23, particularly by thermal sealing. Expediently, the coating preventing a tight seal and being disposed at the top face of the folding flap 17 in the region of the closing flap 23 is not applied in the region of the foil piece 41, so that this coating-free piece can be sealed directly and tightly with the closing flap 23. When the pack is opened via the adhesive tape 35, the foil piece 41 is severed out of the folding flap 17 when the folding flap 18 is lifted, thus forming the recess 39.

The designs of the recess 39 and the foil piece 41 of the embodiment as shown in FIG. 3 are different from those of the embodiment as shown in FIGS. 1 and 2. Firstly, the recess 39 and therewith the foil piece 41 extend up into the region of the longitudinal edge 34 facing the front wall 11. This provides an access to the paper tissues 43 across the full height or width of the side wall 14. Furthermore, the perforation 40 for delimiting the foil piece 41 is formed approximately like the end segment of an ellipse, i.e. slightly curved with a rounded part 51 at the free end, so that the foil piece 41 and correspondingly the recess 39 have a tongue-like shape.

Moreover, the seal for fixing the foil piece 41 on the folding flap 18 is in the form of a sealing strip 45, in analogy to the sealing strips 44 for attaching the side cross-strips 28, 29.

The perforation 40 for limiting the foil piece 41 is formed such that in a center region there is a continuous severance cut 42 from which extend end portions formed as perforations.

The opening aid formed this way can alternatively also be arranged in the region of the end face 15 if the form of the folding flaps is appropriately altered to suit such a design.

What is claimed is:

1. A soft pack, having a closed position and an open position, for storing a stack of paper tissues and comprising a wrapping made of thin sealable plastic foil, wherein:

the wrapping completely surrounds the stack and forms a large-surfaced front wall (11), a rear wall

(12) having a width, opposite narrow elongated side walls (13 and 14) having a width (47), and opposite small end walls (15 and 16), thereby forming a substantially cuboid-shaped pack;

one (14) of said narrow elongated side walls is formed by an elongated inner folding flap (17) having a width (46) and by an elongated outer folding flap (18) having a width (48), which flaps overlap one another and are connected to one another;

said width (46) of said elongated inner folding flap (17) being only very slightly narrower than that (47) of said one narrow elongated side wall (14) and having an elongated free edge (17*a*);

said outer folding flap (18) defines a closing flap (23) having a length shorter than the length of said outer folding flap (18);

said closing flap (23) is defined, in said closed position, only by lateral parallel continuous linear severing cuts (24, 25) which continuously extend over the entire said width (48) of said outer folding flap (18) without any residual connecting webs (50) of said wrapping, and also only be lines (32,33) of perforations (49) separated by residual connecting webs (50) of said wrapping, said lines (32,33) being only linear extensions of said severing cuts (24,25) and extending in only an adjoining portion of the adjacent rear wall (12), said adjoining portion having a width less than the width of said rear wall;

said severing cuts define, in said open position, a tissue-extraction opening (30) in said adjoining portion of said rear wall (12), thereby exposing a top surface of said stack of tissues;

said outer folding flap (18) has strip portions (28,29) which are located beyond said closing flap (23) on opposite longitudinal extremities of said outer folding flap (18) and which are bonded to said inner folding flap (17) by sealing strips (44) to form a durable connection between said inner folding flap (17) and said strip portions (28,29);

there is provided, in a middle region of said pack, an adhesive tape (35) which has an adhesive-free grip end (38) and which is connected at one end thereof to the front wall (11) and at another end thereof to said closing flap (23) of said outer folding flap (18), said adhesive-free grip end (36) being an extension of said one end of said adhesive tape (35); and at end portions adjacent to the end walls (15 and 16), the inner folding flap (17) is free of severing cuts and perforation lines.

2. The pack according to claim 1, wherein said opposite end walls (15 and 16) are formed by folding flaps (19, 20; 21, 22) folded envelope-like against opposite ends of said pack.

* * * * *